US005896596A

United States Patent [19]

Murakami

[11] Patent Number: 5,896,596

[45] Date of Patent: Apr. 27, 1999

[54] APPARATUS FOR GENERATING MASSAGING WATER STREAM

[75] Inventor: Eiichi Murakami, Matsudo, Japan

[73] Assignees: Nitto Kogyo Co., Ltd.; Rally Master Co., Ltd., both of Tokyo, Japan

[21] Appl. No.: 08/956,121

[22] Filed: Oct. 22, 1997

[51] Int. Cl.[6] ..... A47K 3/02

[52] U.S. Cl. ..... 4/541.1

[58] Field of Search ..... 4/541.1–541.6, 4/904

[56] References Cited

U.S. PATENT DOCUMENTS

| | | | |
|---|---|---|---|
| 4,197,815 | 4/1980 | Brazelton | 4/904 X |
| 4,371,995 | 2/1983 | Donhauser | 4/541.2 X |
| 5,010,065 | 4/1991 | Shiina et al. | 4/541.3 X |

FOREIGN PATENT DOCUMENTS

| | | | |
|---|---|---|---|
| 0295257 | 11/1916 | Germany | 4/541.1 |

*Primary Examiner*—Charles E. Phillips
*Attorney, Agent, or Firm*—Varndell Legal Group

[57] ABSTRACT

An apparatus for generating a high power water stream performing an effective massage without producing undesired vibration and noise including an outer tub 1, an inner tub 2 arranged within the outer tub, passages 3 formed in a bottom wall of the outer tub, passages 2*c* formed in a side wall of the inner tub, a tubular members 4 provided at the passages 2*c* and having inner diameters which are gradually increased toward an inner space S3, a pump 5 arranged between a space S2 between side walls of outer and inner tubs and having jet nozzles 8 which are positioned at inlets of the jet nozzles, and a motor 7 coupled with the pump 5 by means of a drive shaft assembly 6. When the motor 7 is energized to drive the pump 5, water streams are projected at a very high speed from the jet nozzles into the tubular members 4. Then, the water in the space S2 is sucked into the inlets of the tubular members, and the water streams are projected from the outlets of the tubular members 4 at a very high speed. These water streams have a sufficiently high velocity, and thus the massaging efficiency is very high.

5 Claims, 3 Drawing Sheets

APPARATUS FOR GENERATING MASSAGING WATER STREAM

BACKGROUND OF THE INVENTION

1. Field of the Invention

The present invention relates to an apparatus for generating a massaging water stream by forcedly circulating a water in a bath-tub, said water stream having a sufficient power for massaging a user in the bath-tub.

2. Description of the Related Art

Heretofore, there has been proposed an apparatus for generating a water stream within a bath-tub, said water stream having such velocity and flow rate that a user in the bathtub is subjected to impact by the water stream to perform a massage. Such a massaging water stream can be effectively used for attaining various functions such as beauty, health and physical practice.

In a known massaging water stream generating apparatus, a motor and a propeller coupled with a driving shaft of the motor are arranged within a bath-tub, and therefore the apparatus is liable to be complicated in construction and large in size. For attaining a sufficient massaging effect, it is generally required to generate the water stream having a velocity not less than 2 m/sec. Then, it is necessary to use a propeller having a relatively large diameter. In order to drive such a large propeller, it is required to use the large motor of higher power. Then, the apparatus produces very large vibration as well as a very large noise of about 90 dB.

Moreover, in order to operate the propeller at a high efficiency, it is advantageous to form a rectilinear portion having a low resistance against the stream of water behind the propeller. However, in the known apparatus, it is impossible to form such a rectilinear portion behind the propeller, and thus an efficiency of the propeller is relatively low. Further, since the motor is embedded in the water, it is necessary to provide a water seal between the driving shaft and the motor housing. This would make the maintenance difficult and expensive, because the water seal has to be replaced at regular intervals. Moreover, in order to protect the user from being damaged or injured by the propeller rotating at a high revolving speed, a suitable member such as a mesh has to be provided around the propeller. It is apparent that this protection member increases the resistance against the massaging water stream. Due to the above mentioned various problems, the known apparatus could not generate a powerful water stream having a sufficient massaging function without producing undesired vibration and noise.

SUMMARY OF THE INVENTION

The present invention has for its object to provide a novel and useful apparatus for generating a massaging water, in which the above mentioned drawbacks of the known apparatus can be removed or mitigated, and a powerful massaging water stream can be generated without producing large vibration and noise. According to a first aspect of the invention, an apparatus for generating a massaging water stream comprises:

an outer tub having a bottom wall and a side wall;

an inner tub having a bottom wall, a side wall and at least two passages, one being formed in said bottom wall and the other being formed in said side wall, and being arranged in the outer tub such that a space is formed therebetween, said space being communicated with an inner space formed by the inner tub through said passages; and a water circulating means arranged in said space between the outer and inner tubs for generating a massaging water stream which circulates through said inner space of the inner tub and said space between the inner and outer tubs via said passages;

wherein said water circulating means comprises:

at least one tubular member arranged in said passage formed in said side wall of the inner tub and having an inner diameter which is gradually increased toward the inner space of the inner tub; and a pump arranged in said space between the inner and outer tubs and having at least one jet nozzle which is arranged at an inlet of said tubular member such that the water in said space between the inner and outer tubs is sucked into said inlet by means of a high speed water stream projected from said jet nozzle of the pump.

According to a second aspect of the invention, an apparatus for generating a massaging water stream comprises:

a tub having a bottom wall and a side wall;

a partition wall arranged in said tub such that an inner space of the tub is separated into a main space having such a large volume that a user can sit therein and a sub-space which is communicated with said main space via at least one passage formed in said partition wall and a bottom passage formed between the bottom wall of the tub and a bottom end of said partition wall; and a water circulating means arranged in said sub-space of the tub for generating a massaging water stream which circulates through said main space and sub-space of the tub through said passage and bottom passage; wherein said water circulating means comprises:

at least one tubular member arranged in said at least one passage formed in said partition wall and having an inner diameter which is gradually increased toward the main space of the tub; and a pump arranged in said sub-space and having at least one jet nozzle which is arranged at an inlet of said tubular member such that the water in said sub-space is sucked into said inlet by means of a high speed water stream projected from said jet nozzle of the pump.

In the massaging water stream generating apparatus according to the invention, by projecting the water stream produced by the pump into the inlet of the tubular member whose inner diameter is gradually increased toward the outlet, the water around the inlet of the tubular member is efficiently sucked into the tubular member, and therefore a high power water stream having an effective massaging function can be projected from the tubular member. That is to say, a combination of the pump with jet nozzle and tubular member constitutes a so-called jet-pump, and a very powerful water stream can be obtained. Since there is not provided the propeller, undesired vibration and noise can be effectively avoided or suppressed.

DESCRIPTION OF THE PREFERRED EMBODIMENT

Figure 1:
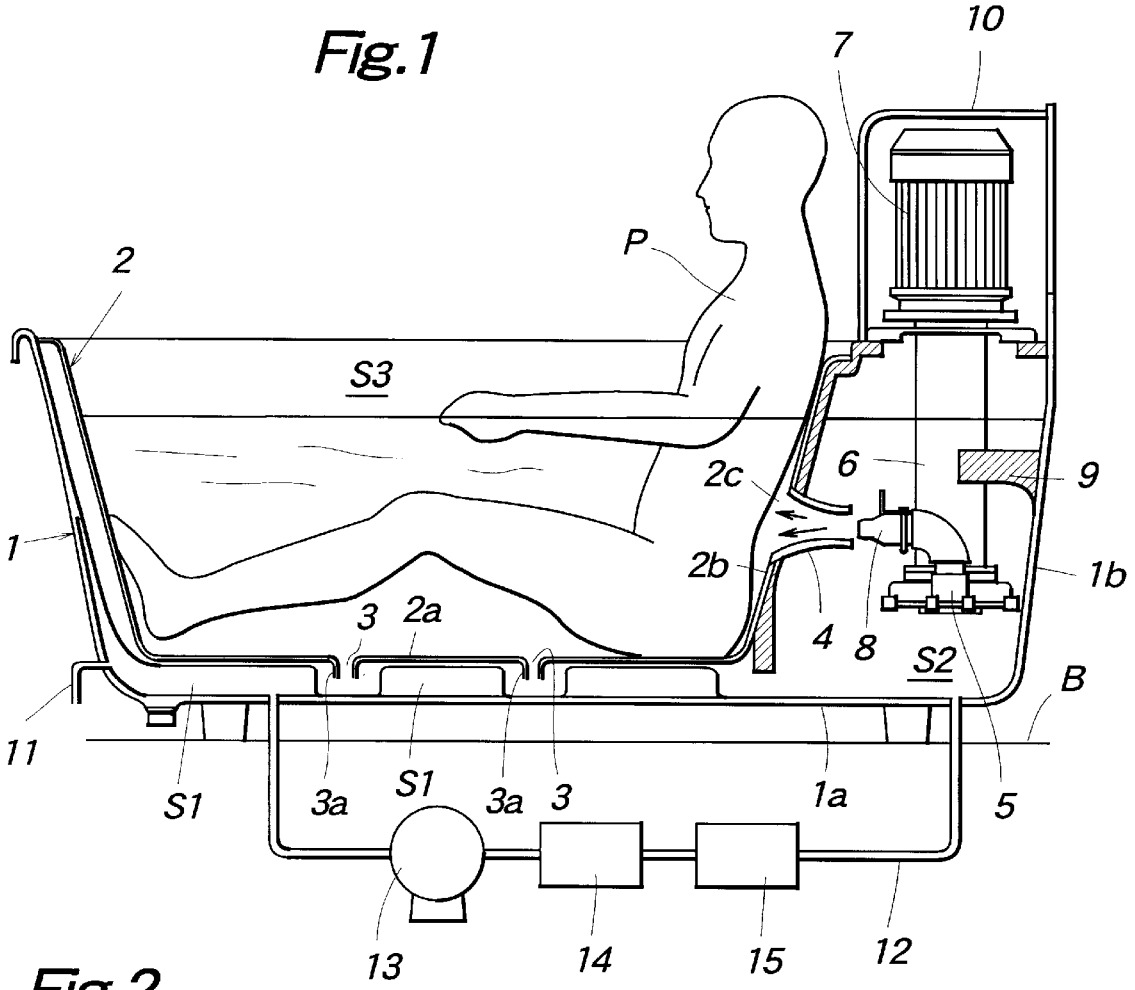
FIG. 1 is a cross sectional view showing a first embodiment of the massaging water stream generating apparatus according to the invention.
Figure 2:
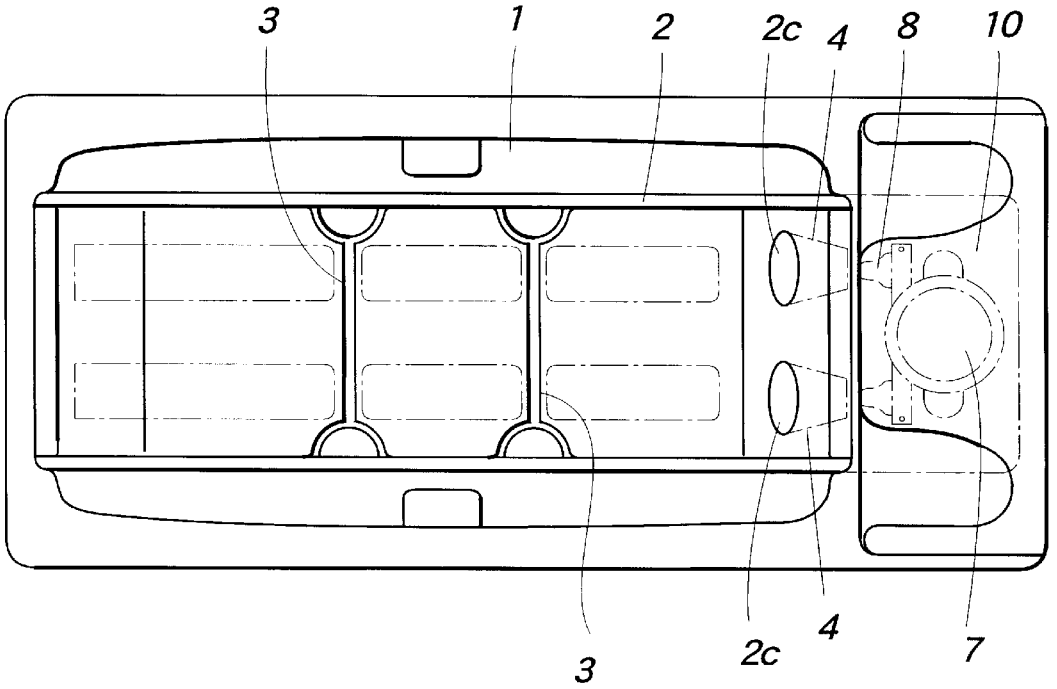
FIG. 2 is a plan view illustrating the first embodiment of the massaging water stream generating apparatus according to the invention.
Figure 3:
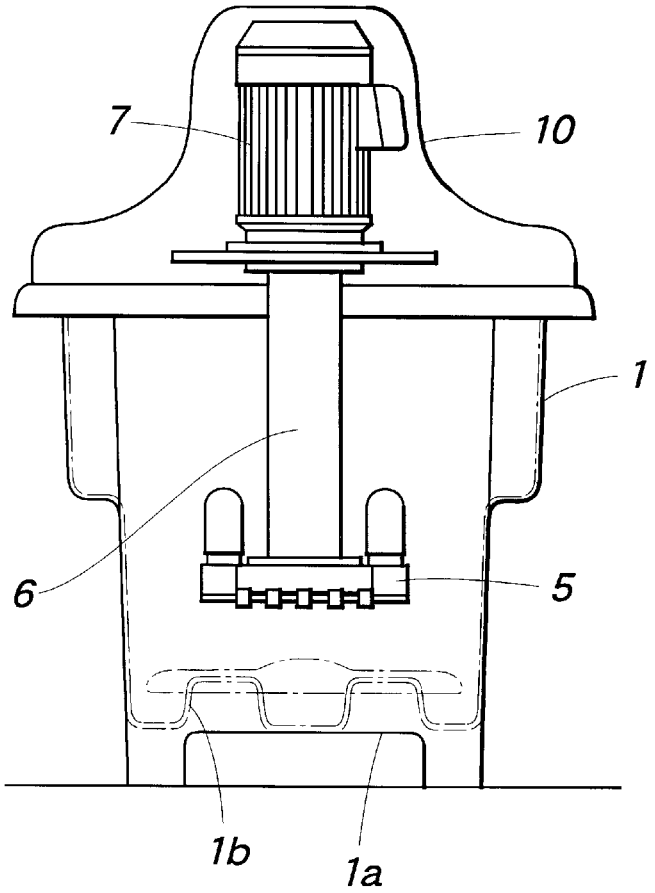
FIG. 3 is a side view of the first embodiment.

FIGS. 1–3 illustrate a first embodiment of the massaging water stream generating apparatus according to the invention. The apparatus comprises an outer tub 1 having a bottom wall 1*a* and a side wall 1*b* and being placed on a base B with a certain distance, and an inner tub 2 having a bottom wall 2*a* and a side wall 2*b*. The inner tub 2 is arranged on the bottom wall 1*a* of the outer tub 1 such that a space S1 is formed between the bottom walls 1*a* and 2*a* of the outer and inner tubs. The outer and inner tubs 1 and 2 are constructed to have such size and strength that a user P can sit on the bottom wall 2*a* of the inner tub 2 and can be effectively subjected to a massaging water stream as will be explained hereinbelow.

In the bottom wall 2*a* of the inner tub 2, there are formed two slit-like drain grooves 3, and plates 3*a* are secured to the rear surface of the bottom wall 2*a*. Between the side walls 1*b* and 2*b*, there is formed a rather large space S2, and two openings 2*c* are formed in the side wall 2*b* of the inner tub 2 so that the space S2 is communicated with an inner space S3 of the inner tub 2. At the openings 2*c* there are provided tubular members 4 whose inner diameter is gradually increased toward the inner space S3. In the present embodiment, the tubular member 4 is formed in the shape of a trumpet horn whose outlet is secured to the opening 2*c* formed in the side wall 2*b* of the inner tub 2.

Within the space S2 between the side walls 1*b* and 2*b* of the outer and inner tubs 1 and 2, there is arranged a water pump 5 such as centrifugal pump. The pump 5 is coupled with a motor 7 by means of a driving shaft assembly 6, said pump being arranged on an upper flange of the outer tub 1 such that it is free from a water. The pump 5 includes two jet nozzles 8 from which water streams are projected at a high speed. According to the invention, the jet nozzles 8 are arranged such that they are faced with inlets of the tubular members 4. The driving shaft assembly 6 is supported by a projection 9 extending from the side wall 1*b* of the outer tub 1, and a reaction force produced by the pump 5 is received by the projection 9. As shown in FIG. 1, the motor 7 is arranged in a housing 10.

Figure 4:
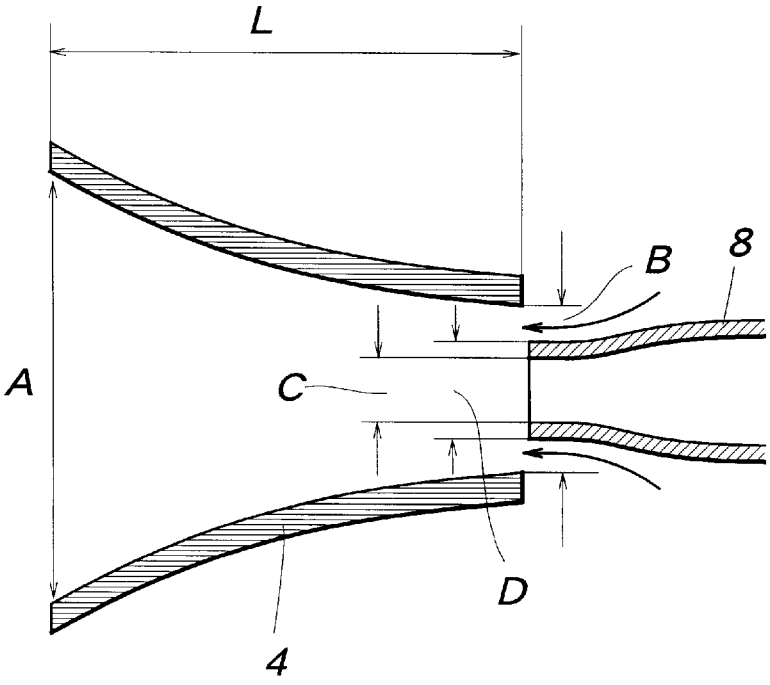
FIG. 4 is a cross section depicting the tubular member.

FIG. 4 illustrates a positional relationship between the tubular member 4 and the jet nozzle 8. As shown in FIG. 4, the jet nozzle 8 is arranged just at the inlet of the tubular member 4. According to the invention, a length L of the tubular member 4 is 100–150 mm, a maximum inner diameter A at the outlet of the tubular member 4 is 200–300 mm, a minimum diameter B of the tubular member 4 at the inlet is 70–80 mm. an inner diameter C of the jet nozzle 8 is 8–10 mm, and an outer diameter D of the nozzle 8 is 20 mm. According to the invention, a configuration of the outlet portion of the tubular member is not limited to have a circle at any cross sectional plane perpendicular to an axial direction of the tubular member. For instance, the tubular member may have rectangular or prolonged or oval cross sectional configuration, in which an inner diameter is gradually increased only in the horizontal direction.

In the present embodiment, an air inlet pipe 11 is connected to a lower portion of side wall 1*a* of the outer tub 1. It is possible to introduce an air into the space S1 through the air inlet pipe 11. Furthermore, to the bottom wall 1*a* of the outer tub 1, is connected a bypass conduit 12, and circulating pump 13, filter 14, and heating and sterilizing device 15 are arranged in the bypass conduit 12.

After the inner and outer tubs 1 and 2 are filled with a water, when the motor 7 is energized to drive the pump 5, a water stream having a velocity of 8–10 m/s is projected from each of the jet nozzles 8. Then, these high speed water streams are introduced into the tubular members 4 and the water around the tubular members and nozzles is sucked into the tubular members, because the tubular member 4 serves as a diffuser. Therefore, from the tubular members 4, very powerful water streams are projected into the inner space S3. In this manner, the water is circulated from the pump 5, nozzles 8, tubular members 4, inner space S3 of the inner tub 2, slit-like passages 3, space S1 formed between the bottom walls 1*a* and 2*a* of the outer and inner tubs and side space S2. In the space S3 within the inner tub 2, it is possible to generate a high power water stream having a velocity of about 4 m/s which can provide a very effective massaging function to the user P. In FIG. 1, the massaging water stream is projected toward a hip of the user P.

According to the invention, the pump 5 does not produce undesired vibration and noise, and the user P hears only low noise generated from the motor 7. Moreover, the motor 7 is arranged above the water level, it is no more necessary to provide a seal between the driving shaft and the motor housing, and therefore the maintenance can be carried out easily at a low cost. Further, the electric wiring may be also made simple.

In the present embodiment, the number of jet nozzles 8 of the pump 5 is set to two in order to prevent the pump from twisting about the driving shaft, but according to the invention, only one jet nozzle may be provided, if the twisting movement of the pump is not serious. Further the number of the tubular member 4, pump 5 and jet nozzle 8 may be set to any suitable number.

The air introduced from the air inlet 11 or possibly introduced into the water is retained in an upper portion of the space S1 as an air layer due to the function of the plates 3*a* provided on the rear surface of the bottom wall 2*a* of the inner tub 2, and thus the air gives only a very small resistance against the water stream. Therefore, the water stream in the space S1 is subjected only to a small contact resistance with respect to the bottom wall 1*a* of the outer tub 1 and a water front loss is materially reduced.

It is also possible to form one or more passages in the bottom wall 2*a* of the inner tub 2 so as to form a water stream flowing along complicated paths. In order to increase the mechanical strength of the inner tub 2, it is desired to provide a rib on a rear surface of its bottom wall 2*a*. Even in this case, the rib is formed within the air layer, and therefore the rib does not act as a resistance against the water stream.

A part of the water is flowed into the bypass conduit 12 by means of the circulating pump 13, and therefore impurities contained therein can be removed by the filter 14 and a temperature of the water is controlled and the water is sterilized by the heating and sterilizing device 15.

Figure 5:
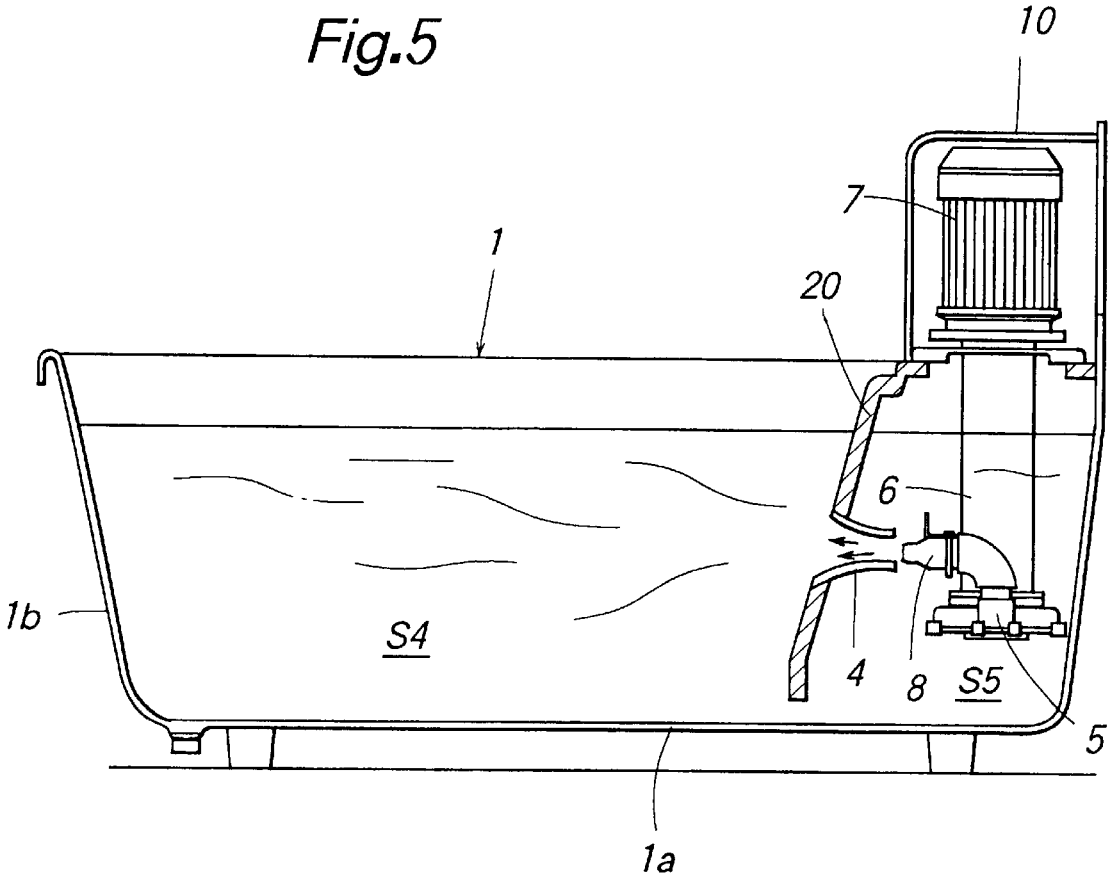
FIG. 5 is a cross sectional view showing a second embodiment of the massaging water stream generating apparatus according to the invention.

FIG. 5 is a cross sectional view showing a second embodiment of the massaging water stream generating apparatus according to the invention. In the first embodiment, the water stream is circulated through the space S1 between the bottom walls 1*a* and 2*a* of the outer and inner tubs 1 and 2. In the second embodiment, instead of providing the inner tub, a partition wall 20 is arranged in the tub 1 having the bottom wall 1*a* and side wall 1*b* so as to divide an inner space of the tub into a main space S4 having a sufficiently large volume that the user can sit within the main space, and a sub-space S5. In the partition wall 20, there are secured two tubular members 4 having the same construction as that of the previous embodiment. In the sub-space S5, there is arranged a pump 5 having two jet nozzles 8 whose outlets are arranged at the inlets of the tubular members 4. The pump 5 is coupled with a motor 7 by means of a driving shaft assembly 6.

The partition wall 20, pump 5, driving shaft assembly 6 and motor 7 are coupled with each other by means of a suitable frame not shown as a single integral body, and this assembly is provided on the tub 1. Therefore, the present embodiment may be easily applied to an existing bath-tub.

In the present embodiment, the water stream projected from the pump nozzles 8 is circulated through the tubular members 4, main space S4, a space formed between the bottom wall 1*a* of the tub 1 and a bottom end of the partition wall 20, sub-space S5 and pump 5.

The present invention is not limited to the embodiments explained above, but many alternations and modifications may be conceived by those skilled in the art with the scope of the invention. In the above embodiments, there are provided two pump nozzles and two corresponding tubular members, but according to the invention, only one pump nozzle and only one tubular member may be provided.

Figure 6A:
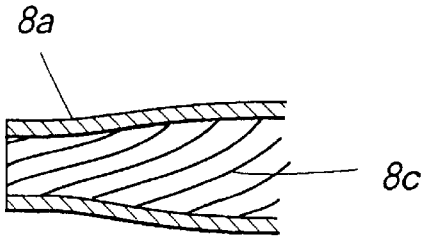
FIGS. 6A and 6B are cross sectional views depicting nozzles of a third embodiment of the massaging water stream generating apparatus according to the invention.
Figure 6B:
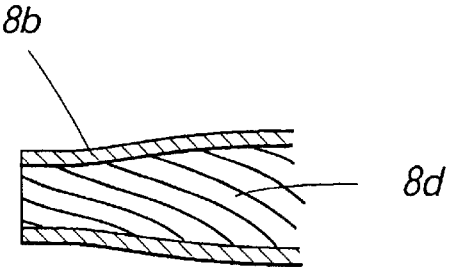

FIGS. 6A and 6B are cross sectional views showing another embodiment of the jet nozzles 8*a* and 8*b* according to the invention. In the present embodiment, in inner surfaces of these nozzles 8*a* and 8*b* are formed helical grooves 8*c* and 8*d,* respectively. In the present embodiment, the helical grooves 8*c* and 8*e* are preferably formed in opposite directions, but according to the invention, these grooves may have the same direction.

By forming the above mentioned helical grooves 8*c* and 8*d* in the inner surfaces of the nozzles 8*a* and 8*b,* respectively, the water stream projected from these nozzles rotate in opposite directions. Therefore, the massaging effect of the rotating water streams can be effectively increased. It should be noted that the nozzle with the helical grooves may be advantageously applied to the massaging water stream generating apparatus according to the invention, in which only one nozzle and only one tubular member are provided.

As explained above in detail, in the massaging water stream generating apparatus according to the invention, it is possible to obtain the high power water stream having a sufficiently high massaging function without producing undesired vibration and noise.

What is claimed is:

1. An apparatus for generating a massaging water stream comprising:

an outer tub having a bottom wall and a side wall;

an inner tub having a bottom wall, a side wall and at least two passages, one being formed in said bottom wall and the other being formed in said side wall, and being arranged in the outer tub such that a space is formed therebetween, said space being communicated with an inner space formed by the inner tub through said passages; and a water circulating means arranged in said space between the outer and inner tubs for generating a massaging water stream which circulates through said inner space of the inner tub and said space between the inner and outer tubs via said passages;

wherein said water circulating means comprises:

at least one tubular member arranged in said passage formed in said side wall of the inner tub and having an inner diameter which is gradually increased toward the inner space of the inner tub;

a pump arranged in said space between the inner and outer tubs and having at least one jet nozzle which is arranged at an inlet of said tubular member such that the water in said space between the inner and outer tubs is sucked into said inlet by means of a high speed water stream projected from said jet nozzle of the pump; and a motor which is coupled with said pump for driving the pump by means of a driving shaft.

2. An apparatus according to claim 1, wherein two openings are formed in the side wall of the inner tub and two tubular members are provided at these openings.

3. An apparatus according to claim 2, wherein said two tubular members have helical grooves formed in inner surfaces thereof.

4. An apparatus according to claim 3, wherein said helical grooves formed in the inner surfaces of the two tubular members have opposite directions.

5. An apparatus according to claim 1, wherein said motor is provided above the outer tub.

* * * * *